US006202858B1

(12) United States Patent
Moewes

(10) Patent No.: US 6,202,858 B1
(45) Date of Patent: Mar. 20, 2001

(54) METHOD FOR SORTING IC-COMPONENTS

(75) Inventor: Harro Moewes, Engelskirchen (DE)

(73) Assignee: MCI Computer GmbH, Engelskirchen (DE)

( * ) Notice: Subject to any disclaimer, the term of this patent is extended or adjusted under 35 U.S.C. 154(b) by 0 days.

(21) Appl. No.: 09/331,361

(22) PCT Filed: Dec. 19, 1997

(86) PCT No.: PCT/EP97/07217

§ 371 Date: Aug. 23, 1999

§ 102(e) Date: Aug. 23, 1999

(87) PCT Pub. No.: WO98/28091

PCT Pub. Date: Jul. 2, 1998

(30) Foreign Application Priority Data

Dec. 21, 1996 (DE) ..... 196 53 780

(51) Int. Cl.[7] ..... B07C 5/00

(52) U.S. Cl. ..... 209/936; 209/925; 209/643; 198/370.01; 414/416

(58) Field of Search ..... 209/643, 639, 209/925; 198/370.01; 414/416

(56) References Cited

U.S. PATENT DOCUMENTS 3,664,499 * 5/1972 Sahakian ..... 209/573
4,908,126 3/1990 Willberg et al. .
5,307,011 4/1994 Tani .
5,484,062 1/1996 Rich .
5,680,936 * 10/1997 Beers ..... 209/564

FOREIGN PATENT DOCUMENTS 35 39 968 A1 11/1985 (DE) .
36 38 430 A1 11/1986 (DE) .

* cited by examiner

*Primary Examiner*—Donald P. Walsh
*Assistant Examiner*—Jonathan R Miller
(74) *Attorney, Agent, or Firm*—Fish & Richardson P.C., P.A.

(57) ABSTRACT

A method and system for sorting IC-components into predefinable classes of criteria simultaneously remove a plurality of the IC-components from receiving portions of a tray using a plurality of gripping devices. Each of the gripping devices having an access area that is separate from access areas associated with the other gripping devices. The tray is moved in steps past the gripping devices. Each of the gripping devices is controlled to remove from the receiving portions of the tray only the IC-components belonging to one class of criteria assigned to the access area of the respective gripping device.

22 Claims, 4 Drawing Sheets

METHOD FOR SORTING IC-COMPONENTS

TECHNICAL FIELD

Figure 1:
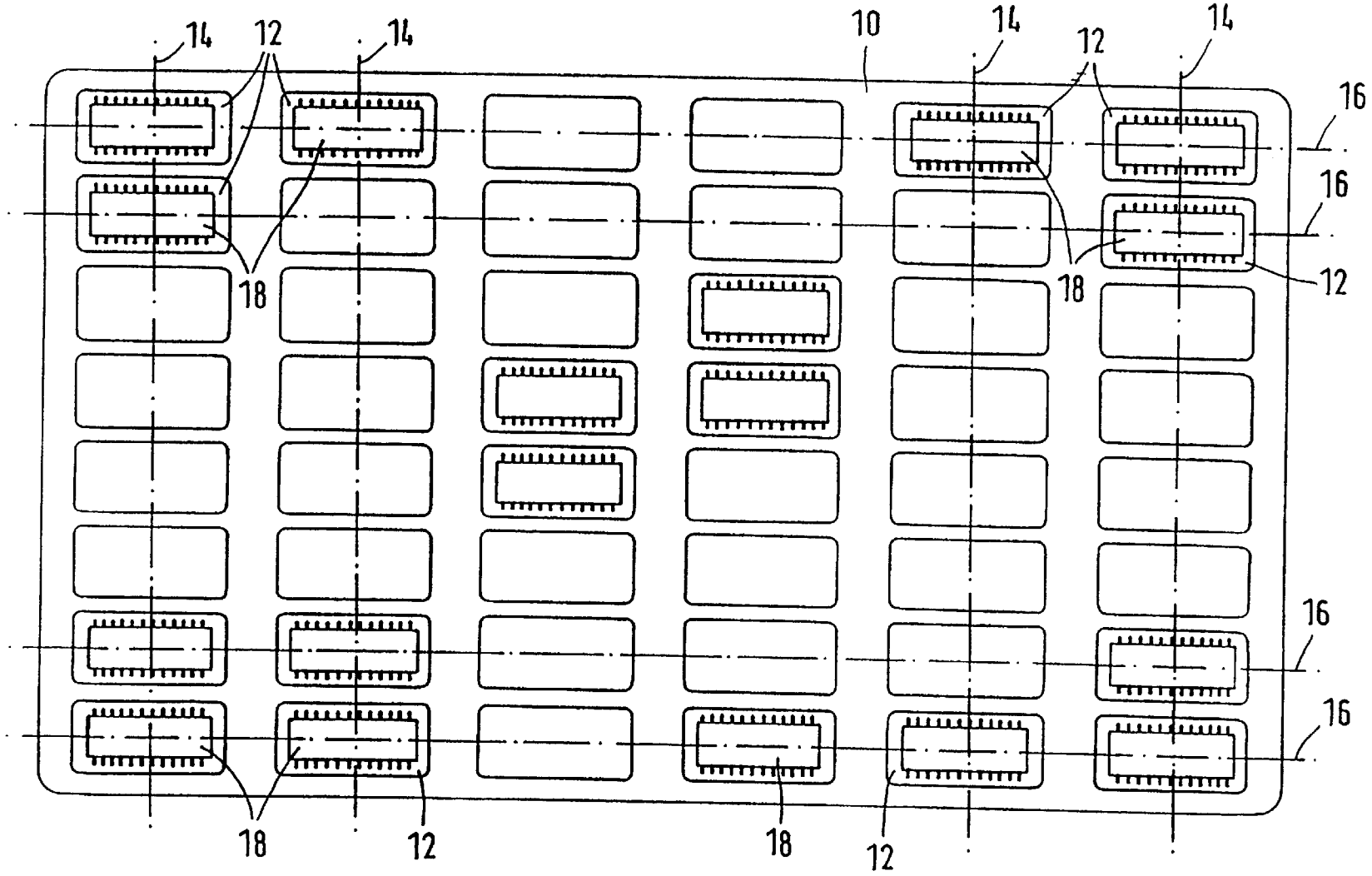

The invention relates to a method for the sorting of IC-components which during manufacture in the back-end stage are sorted corresponding to pre-definable classes of criteria and particularly are sorted into different classes corresponding to their test results.

BACKGROUND

In the production of IC-components, the components are subjected to various tests in the back-end stage. Subsequently, the IC-components are sorted into different classes corresponding to their test results. The sorting process is performed with the aid of a plurality of gripping means which access the individual receiving portions of the trays on which the IC-components are transported in the back-end stage. Each gripping means can access each IC-component to pick it up, classify it corresponding to its test results and to deposit it. This process is relatively time-consuming.

Further, testing and sorting devices are known from DE 35 39 968 A1 and DE 36 38 430 A1 wherein the components are sequentially tested and corresponding to their test results are supplied successively to one of a plurality of magazines.

SUMMARY

It is the object of the invention to provide a sorting method for the sorting of IC-components in the back-end stage which is highly effective and by which all of the IC-components of a tray are sorted into different classes in the shortest time possible.

For solving the above object, there is proposed in accordance with the invention a method for the sorting of IC-components in the back-end stage corresponding to pre-definable classes of criteria, wherein

- the IC-components are simultaneously removed from receiving portions of a tray by a plurality of gripping means,
- each gripping means has a pre-definable access area for the removal of IC-components from receiving portions of the tray, with the access areas of all gripping means being free of mutual overlapping,
- the tray is moved in steps past the gripping means, and
- each gripping means removes only the IC-components belonging to one class of criteria from the receiving portions of the tray belonging to the access area of the respective gripping means.

In the method according to the invention, use is made of a plurality of gripping means whose number is at least equal to the number of classes into which the IC-components are to be sorted. Each gripping means has a specific access area assigned thereto within which the gripping means can travel to remove IC-components from the receiving portions of the trays. All of the access areas are free of any overlapping with each other. The tray is moved past the gripping means so that each receiving portion of the tray will be moved through the access areas of all of the gripping means. Each gripping means will remove, from those receiving portions of the tray which during the stepwise advance of the tray are presently located in the access area assigned to the gripping means, only those IC-components which on the basis of the respective pre-defined criteria, e.g. on the basis of the test results, are to be assigned to a specific class.

Thus, in the method of the invention, a sequential stepwise transport of the trays past the gripping means is performed, with the gripping means accessing the IC-components in parallel. In this manner, the effectiveness of the sorting mechanism and of the sorting method, respectively, is decisively increased to the effect that the sorting method is performed continuously, as it were, instead of the previously known batch-like operation.

For a case when a gripping means has to access a larger-than-average number of IC-components presently located in its access area because all of these IC-components belong to the self-same class, it is of advantage to provide a plurality of gripping means per class. Due to the stepwise transport of the tray, this plurality of gripping means per class is serviced sequentially. That gripping means which is first serviced will remove a maximum number of IC-components. The time period required therefore is adapted to the dwell time in the rest condition and thus to the cycle rate of the stepwise transport of the tray. Should not all of the IC-components of the class assigned to the first gripping means have been removed within this time period, the next IC-components will be removed by the second gripping means assigned to this class. Also this gripping means will remove a maximum number of IC-components. In as far as the case is imaginable that both gripping means together cannot remove all of the IC-components respectively arranged in their access areas, further gripping means are provided which then can remove the rest of the IC-components of this class from the receiving portions as soon as these are within the access areas of the further gripping means.

Normally, for the transport of IC-components in the back-end production region, use is made of trays comprising a plurality of the deepened receiving portions which are again arranged in a regular manner and particularly in a matrix form, e.g. in mutually orthogonal columns and rows. In such trays, it is suitable to assign to each gripping means one access area which comprises a column (or alternatively a row) of receiving portions of the tray. In this case, all of the gripping means are arranged successively next to each other in the moving direction of the tray. The advance movement of the trays themselves is performed suitably at right angles to the extension of the columns (or alternatively rows) of receiving portions.

An embodiment of the invention will be explained in greater detail hereunder with reference to the Figures.

BRIEF DECEPTION OF THE DRAWINGS

Figure 2:
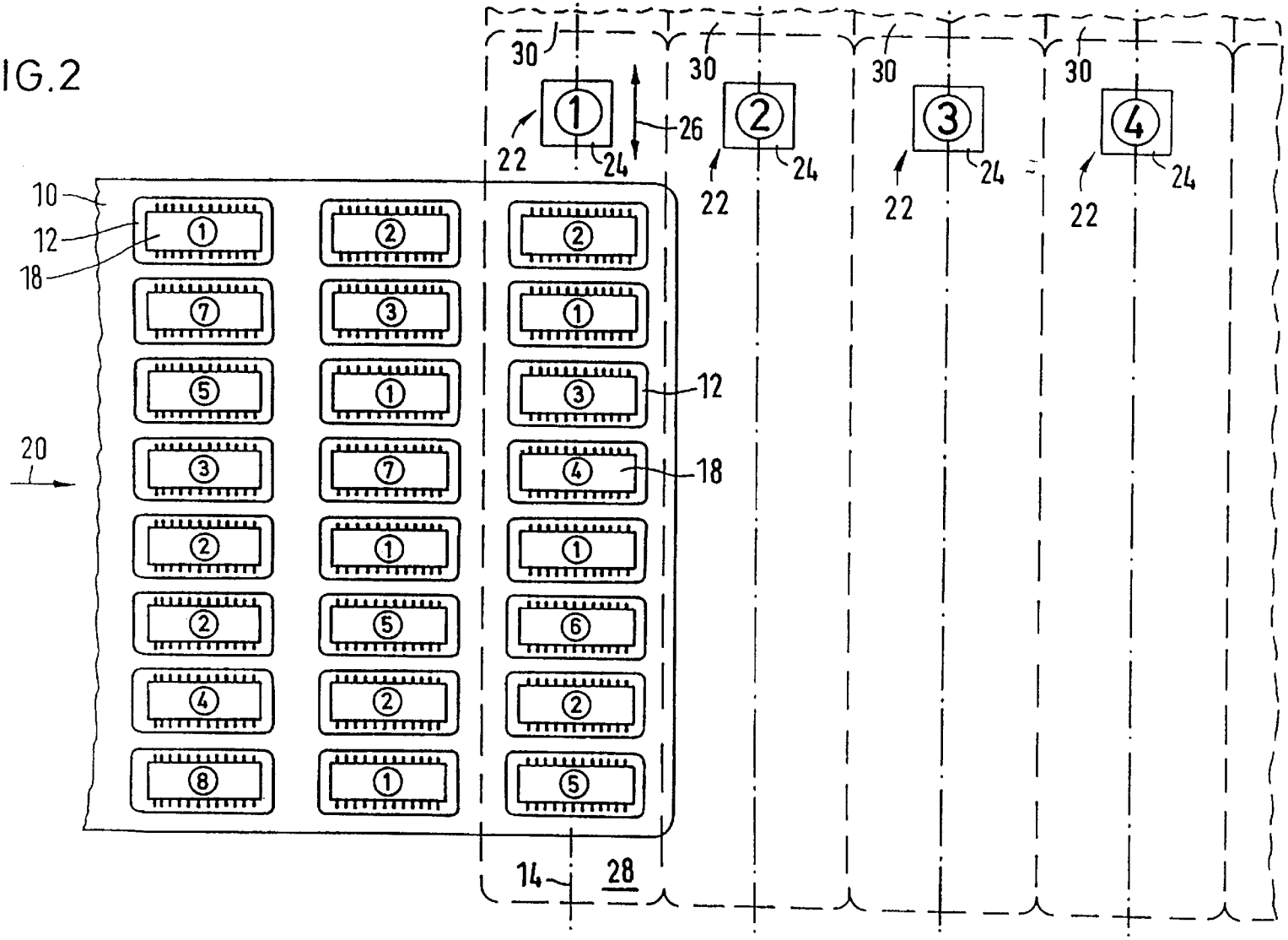
Figure 3:
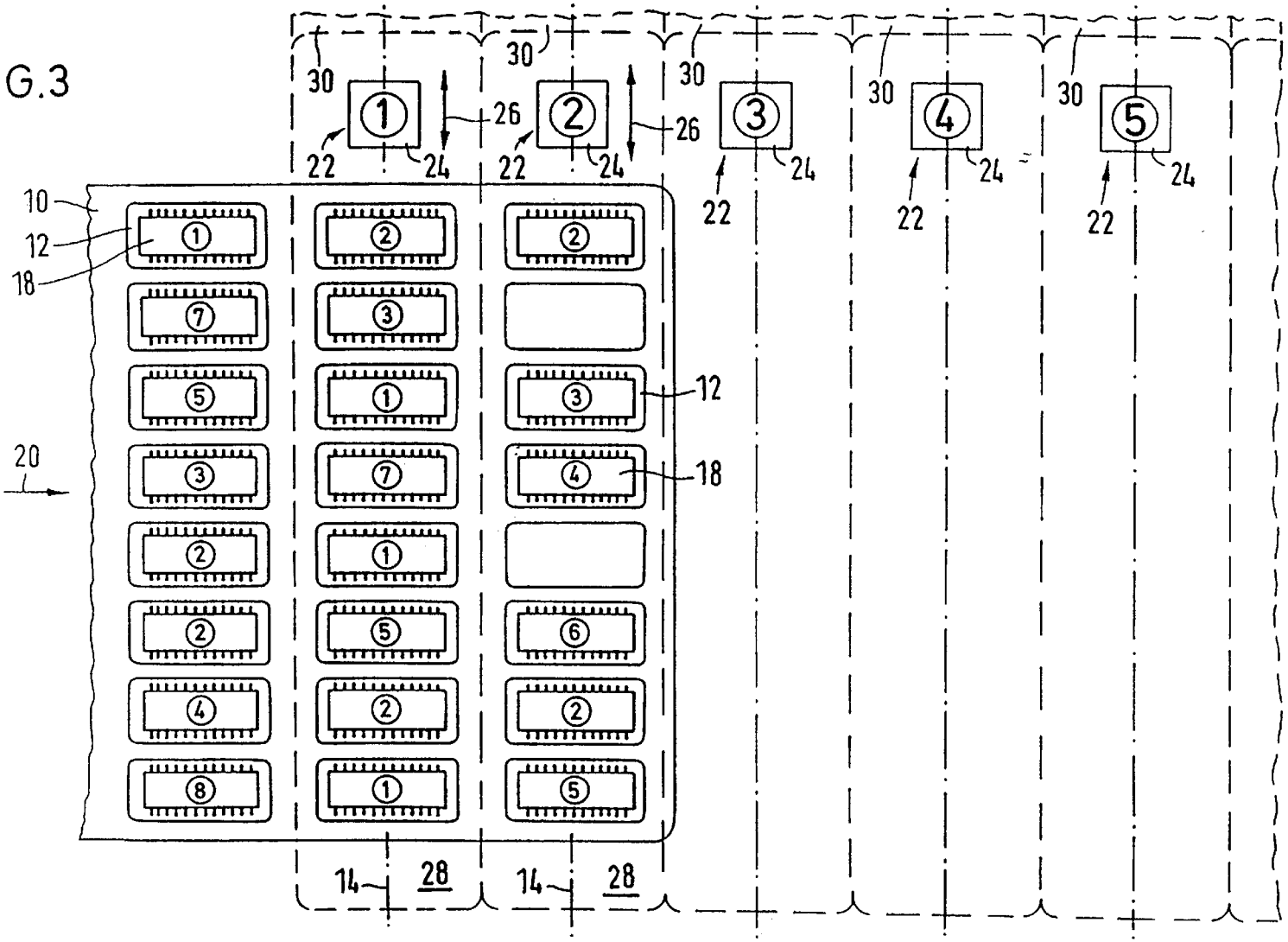
Figure 4:
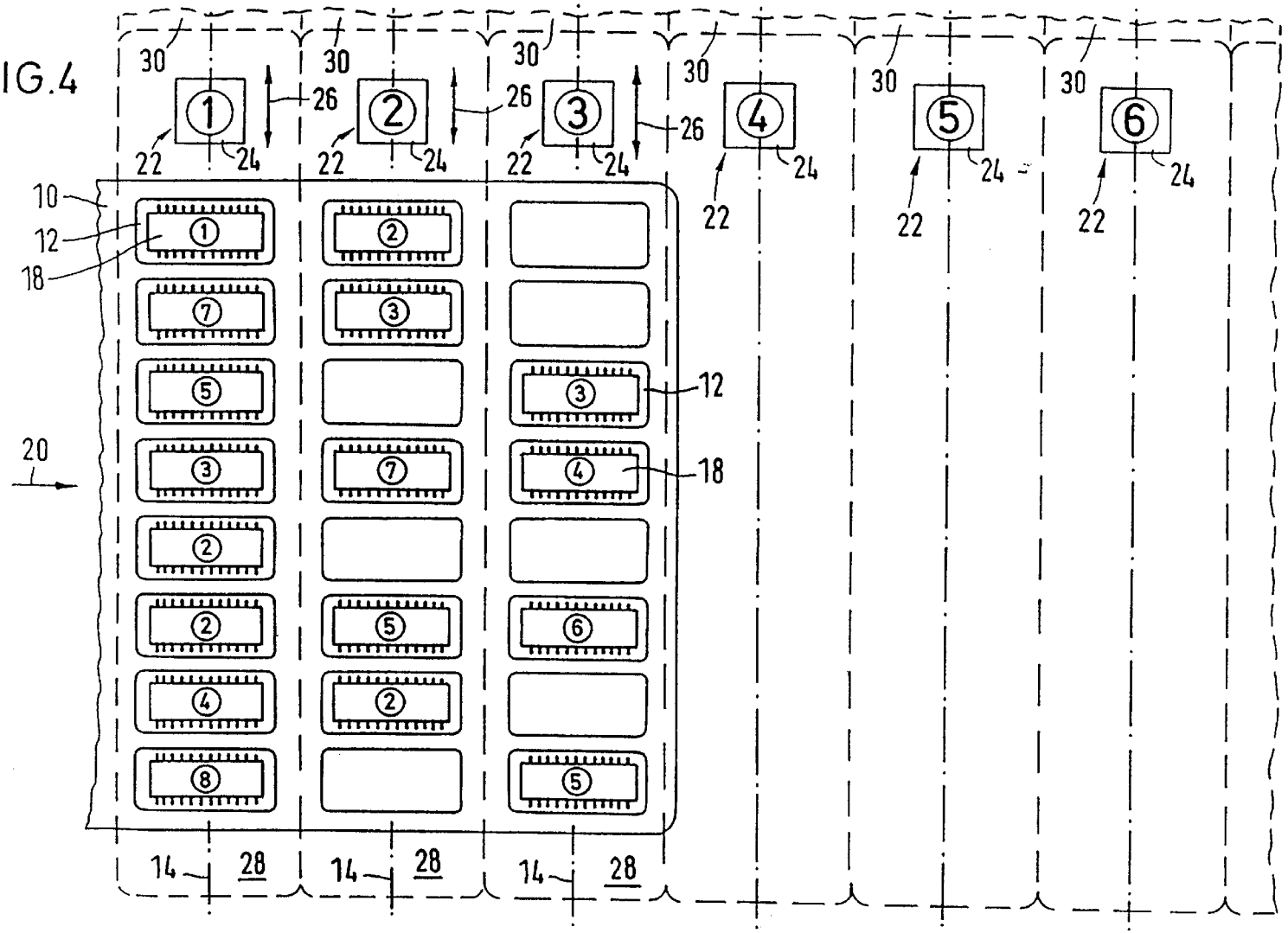

FIG. 1 is a plan view of a tray comprising a plurality of receiving portions for IC-components arranged in a matrix form, and FIGS. 2 to 4 are graphic representations of successive phases during the stepwise advance movement of the tray according to FIG. 1 and during removal of individual IC-components by different gripping means corresponding to the classes to which the IC-components have been assigned on the basis of test results.

DETAILED DESCRIPTION

FIG. 1 shows a plan view of a plastic tray as used in the back-end stage in the manufacture of IC-components for transporting the latter. The tray 10 comprises a plurality of deepened receiving portions 12 positioned in a regular manner. These deepened receiving portions 12 are arranged in mutually orthogonal columns 14 and rows 16 on tray 10. The deepened receiving portions 12 contain IC-components 18 which have been subjected to a plurality of tests of various types. The individual test results are stored in a memory while allocated to the receiving positions of the IC-components 18 within tray 10. On the basis of the results of the tests, the IC-components 18 can be assigned to different classes and groups, respectively. Also this class or group assignment is stored in the memory for each IC-component 18, notably with regard to its receiving position within tray 10. Subsequent to the tests, it is stored in the memory, for instance, that the IC-component 18 which is arranged e.g. in the first column 14 from the right in the representation of FIG. 1 and in the fifth row 16 from above in the representation of FIG. 1, has to be assigned to class 3.

For sorting the IC-components 18 of tray 10, the latter is moved according to FIG. 2 in the direction of arrow 20 past a plurality of suction gripping means 22 arranged in series in the transport direction 20 of tray 10. Each suction gripping means 22 comprises a suction head 24 arranged for advance and return movement over tray 10 performed rectangularly to the transport direction of tray 10, which is indicated by the double-pointed arrows 26. In other words, each suction head 24 moves within an access area 28 arranged in the extension of the column 14 of the deepened receiving portions 12 of tray 10. The access areas 28 of the suction gripping means 22 are arranged laterally to each other and behind each other, respectively, in the transport direction 20 of tray 10.

The movement of the tray 10 in the transport direction 20 is carried out in steps, with the tray 10 being moved in a clocked manner each time by the width of one column 14 and then is brought to a standstill for a predetermined period of time. In this manner, the tray 10 is sequentially moved past all of the suction gripping means 22.

FIG. 2 illustrates the situation in which the tray 10 has been advanced so far that its leading column 14 of receiving portions 12 in the transport direction 20 is located within the access area 28 of the first suction head 24. The encircled arabic numbers of the IC-components 18 and the suction heads 24 of FIGS. 2 to 4 indicate to which of a total of eight classes a IC-component 18 belongs or which suction head 24 removes IC-components 18 of which class from tray 10. In FIG. 2, after the stepwise advance transport and during the time of standstill of tray 10, the suction head 24 assigned to class 1 accesses the IC-components 18 of the first column 14 in order to remove the two IC-components 18 designated by class 1 in the rows 2 and 5 (counted from above in the representation of FIG. 2). Suction head 24 sequentially removes these two IC-components 18 and deposits them at a transfer site 30 assigned to the suction gripping means 22, from where the sorted-out IC-components 18 are transported further on or are placed in a magazine.

After the two IC-components 18 assigned to class 1 have been removed from the first column 14 and the time of time of standstill of tray 10 has lapsed, tray 10 is advanced by the width of one column 14 in the transport direction 20 and then is stopped again. Thereafter, the situation will be again that according to FIG. 3; now, the leading two columns 14 of receiving portions 12 of tray 10 as viewed in the transport direction 20 are located within the access areas 28 of the first two suction gripping means 22 provided for sorting out IC-components 18 of classes 1 and 2. In the situation shown in FIG. 3, the two suction heads 24 for classes 1 and 2 will access the second and first columns of deepened receiving portions 12 in the transport direction. In the process, the suction head 24 assigned to class 2 will remove the IC-components 18 in the uppermost and in the last-but one row of the first column, while the suction head 24 assigned to class 1 will remove, from the second column, those IC-components 18 which are arranged in the third, fifth and eight row as counted from above. After lapse of the standstill period, tray 10 is again moved by the width of one column, so that now the first three columns 14 of tray 10 are arranged within the access areas 28 of the suction gripping means 22 assigned to classes 1, 2 and 3. The situation prevailing subsequent to that according to FIG. 3 is illustrated in FIG. 4. The removing process in the situation according to FIG. 4 is performed in parallel by means of three suction heads 24 which access the IC-components 18 located in the deepened receiving portions 12 of the first three columns 14 in as far as these components belong to the classes allocated to the respective suction heads 22. Thus, for instance, the suction head 24 assigned to sort out IC-components of class 3 will access the IC-component in the third row from above of the first column 14 of tray 10. The suction head 24 assigned to sort out IC-components 18 of class 2 will access the IC-components in the uppermost row and in the last-but-one row of the second column of tray 10 in the transport direction, while the suction head 24 assigned to class 1 will remove, from the third column 14 of deepened receiving portions 12 in the transport direction, the third IC-component 18 arranged in the deepened receiving portion 12 of the uppermost row. The controlling of the suction head movements for positioning the suction heads 24 in their traveling directions 26 above the respective IC-components 18 to be gripped will follow the data stored in the memory on the classification of the IC-components 18. Once the tray 10 has been completely moved past the suction gripping means 22 assigned to the eight classes, all of the IC-components 18 of tray 10 will have been removed and stored, while sorted corresponding to their classes, in magazines or the like storage means.

In the embodiment described herein and illustrated in the Figures, respectively one suction gripping means 22 is provided for each class to be sorted out. As long as the relation between the number of deepened receiving portions 12 located simultaneously in an access area 28 of a suction gripping means 22 and the number of classes is not considerably larger than 1, one suction gripping means 22 per class will be sufficient. If, however, the number of possible classes of IC-components 18 is considerably smaller than the number of deepened receiving portions 12 located simultaneously in an access area 28 of a suction gripping means 22, it is to be assumed that each access area 28 of the suction gripping means 22 contains a plurality of IC-components 18 to be sorted out. The sequential removal of a plurality of IC-components 18 per access area 28 requires a certain minimum time period. To be nonetheless able to work with relatively small cycle rates, i.e. with short standstill periods of the tray 10, it is recommended that the removal of identically classified IC-components 18 of a column 14 be distributed over two or more clock cycles. Thus, for instance, two suction heads 24 adjoining each other in the transport direction 20 of tray 10 may be provided for the removal of IC-components 18 of the same class. Since the number of IC-components 18 of this class per column is known, it can be defined before-hand how many and which ones of the identically classified IC-components 18 of a column 14 shall be removed by the two or more suction heads 24 assigned to this class. In this manner, the sorting process can be performed with optimally low time requirements.

What is claimed is:

1. A method for the sorting of IC-components in the back-end stage corresponding to pre-definable classes of criteria, wherein the IC-components are simultaneously removed from receiving portions of a tray by a plurality of gripping means, each gripping means has a pre-definable access area for the removal of IC-components from receiving portions of the tray, with the access areas of all gripping means being free of mutual overlapping, the tray is moved past the gripping means, and each gripping means removes only the IC-components belonging to one class of criteria from the receiving portions of the tray belonging to the access area of the respective gripping means, wherein different gripping means remove IC-components of the same class of criteria from the receiving portions of the tray belonging to the access areas of the respective gripping means.

2. The method according to claim 1, characterized in that each gripping means provided for sorting of IC-components of the same class of criteria will remove not more than a pre-definable maximum number of IC-components of this class from the receiving portions of the tray belonging to the access areas of the respective gripping means.

3. The method according to claim 2, characterized in that the receiving portions of the tray are evenly spaced and that the access areas of the gripping means are identical to each other in size.

4. The method according to claim 2, characterized in that the receiving portions of the tray are arranged in mutually orthogonal columns and rows, that the access areas of the gripping means correspond respectively to a column or alternatively a row of receiving portions of the tray, and that the tray is moved rectangularly to the extension of the columns or alternatively of the rows of receiving portions, with the gripping means being arranged next to each other in the moving direction of the tray.

5. The method according to claim 1, characterized in that the receiving portions of the tray are evenly spaced and that the access areas of the gripping means are identical to each other in size.

6. The method according to claim 1, characterized in that the receiving portions of the tray are arranged in mutually orthogonal columns and rows, that the access areas of the gripping means correspond respectively to a column or alternatively a row of receiving portions of the tray, and that the tray is moved rectangularly to the extension of the columns or alternatively of the rows of receiving portions, with the gripping means being arranged next to each other in the moving direction of the tray.

7. The method according to claim 1, characterized in that the receiving portions of the tray are evenly spaced and that the access areas of the gripping means are identical to each other in size.

8. The method according to claim 7, characterized in that the receiving portions of the tray are arranged in mutually orthogonal columns and rows, that the access areas of the gripping means correspond respectively to a column or alternatively a row of receiving portions of the tray, and that the tray is moved rectangularly to the extension of the columns or alternatively of the rows of receiving portions, with the gripping means being arranged next to each other in the moving direction of the tray.

9. The method according to claim 1, characterized in that the receiving portions of the tray are arranged in mutually orthogonal columns and rows, that the access areas of the gripping means comprises respectively a column or alternatively a row of receiving portions of the tray, and that the tray is moved rectangularly to the extension of the columns or alternatively of the rows of receiving portions, with the gripping means being arranged next to each other in the moving direction of the tray.

10. A method for sorting IC-components into pre-definable classes of criteria, the method comprising:

simultaneously removing a plurality of IC-components from receiving portions of a tray using a plurality of gripping devices, each of the gripping devices having an access area that is separate from access areas associated with other gripping devices;

moving the tray past the gripping devices;

controlling each of the gripping devices to remove from the receiving portions of the tray only the IC-components belonging to one class of criteria assigned to the access area of the respective gripping device; and using different gripping devices to remove from the receiving portions of the tray the IC-components belonging to the same class of criteria assigned to the access area of the respective gripping device.

11. The method of claim 10, further comprising using suction devices as at least part of the gripping devices, each of the suction devices applying suction to grip the respective IC-components.

12. The method of claim 11, further comprising controlling each of the gripping devices such that each gripping device provided for sorting of IC-components of the same class of criteria will remove from the receiving portions of the tray not more than a pre-definable maximum number of the IC-components of the respective assigned to the access area of the respective gripping device.

13. The method of claim 10, further comprising providing the tray with an even spacing of the receiving portions, and providing the gripping devices with access areas that are substantially identical to each other in size.

14. The method of claim 10, further comprising providing the tray such that the receiving portions are arranged in mutually orthogonal columns and rows, and providing the gripping devices such that the access areas and the gripping devices correspond, respectively, to a column or alternatively a row of the receiving portions of the tray, moving the tray rectangularly to the extension of the columns or alternatively of the rows of the receiving portions, and arranging the gripping devices next to each other in the moving direction of the tray.

15. A system for the sorting of IC-components into pre-definable classes of criteria, the system comprising:

a tray having a plurality of receiving portions for the IC-components;

a plurality of gripping devices, each of the gripping devices having an access area that is separate from access areas associated with the other gripping devices;

means for simultaneously removing a plurality of the IC-components from the receiving portions of the tray by application of the gripping devices;

means for moving the tray past the gripping devices; and means for controlling each of the gripping devices to remove from the receiving portions of the tray only the IC-components belonging to one class of criteria assigned to the access area of the respective gripping device;

wherein the controlling means controls the gripping devices such that different gripping devices remove from the receiving portions of the tray the IC-components belonging to the same class of criteria assigned to the access area of the respective gripping device.

16. The system of claim 15, wherein the gripping devices include suction devices, each of the suction devices applying suction to grip the respective IC-components.

17. The method of claim 15, wherein the controlling means controls the gripping devices such that such that each gripping device provided for sorting of IC-components of the same class of criteria will remove from the receiving portions of the tray not more than a pre-definable maximum number of the IC-components of the respective assigned to the access area of the respective gripping device.

18. The system of claim 15, wherein the tray has an even spacing of the receiving portions, and the gripping devices include access areas that are substantially identical to each other in size.

19. The system of claim 15, wherein the receiving portions of the tray are arranged in mutually orthogonal columns and rows, the access areas and the gripping devices correspond, respectively, to a column or alternatively a row of the receiving portions of the tray, and the moving means moves the tray rectangularly to the extension of the columns or alternatively of the rows of the receiving portions, the gripping devices being disposed next to each other in the moving direction of the tray.

20. A method for the sorting of IC-components in the back-end stage corresponding to pre-definable classes of criteria, wherein the IC-components are simultaneously removed from receiving portions of a tray by a plurality of gripping means, each gripping means has a pre-definable access area for the removal of IC-components from receiving portions of the tray, with the access areas of all gripping means being free of mutual overlapping, the tray is moved past the gripping means, and each gripping means removes only the IC-components belonging to one class of criteria from the receiving portions of the tray belonging to the access area of the respective gripping means;

wherein (a) the receiving portions of the tray are arranged in mutually orthogonal columns and rows, (b) the access areas of the gripping means correspond, respectively, to a column or alternatively a row of receiving portions of the tray, and (c) the tray is moved rectangularly to the extension of the columns or the rows of the receiving portions, with the gripping means being arranged next to each other in the moving direction of the tray.

21. A method for sorting IC-components into pre-definable classes of criteria, the method comprising:

simultaneously removing a plurality of IC-components from receiving portions of a tray using a plurality of gripping devices, each of the gripping devices having an access area that is separate from access areas associated with other gripping devices;

providing the tray such that the receiving portions are arranged in mutually orthogonal columns and rows, providing the gripping devices such that the access areas and the gripping devices correspond, respectively, to a column or alternatively a row of the receiving portions of the tray, moving the tray past the gripping devices, rectangularly to the extension of columns or alternatively of the rows of the receiving portions;

arranging the gripping devices next to each other in the moving direction of the tray; and controlling each of the gripping devices to remove from the receiving portions of the tray only the IC-components belonging to one class of criteria assigned to the access area of the respective gripping device.

22. A system for the sorting of IC-components into pre-definable classes of criteria, the system comprising:

a tray having a plurality of receiving portions for the IC-components;

a plurality of gripping devices, each of the gripping devices having an access area that is separate from access areas associated with the other gripping devices;

means for simultaneously removing a plurality of the IC-components from the receiving portions of the tray by application of the gripping devices;

means for moving the tray past the gripping devices; and means for controlling each of the gripping devices to remove from the receiving portions of the tray only the IC-components belonging to one class of criteria assigned to the access area of the respective gripping device;

wherein the receiving portions of the tray are arranged in mutually orthogonal columns and rows, the access areas and the gripping means correspond, respectively, to a column or alternatively a row of the receiving portions of the tray, and the moving means moves the tray rectangularly to the extension of the columns or alternatively of the rows of the receiving portions, the gripping devices being disposed next to each other in the moving direction of the tray.

* * * * *

UNITED STATES PATENT AND TRADEMARK OFFICE

CERTIFICATE OF CORRECTION

PATENT NO. : 6,202,858 B1
DATED : March 20, 2001
INVENTOR(S) : Harro Moewes

It is certified that error appears in the above-identified patent and that said Letters Patent is hereby corrected as shown below:

Claim 17,
Line 2, the phrase "such that" was inadvertently written twice. Please delete the first instance of: -- such that --.

Signed and Sealed this

Sixteenth Day of October, 2001

*Attest:*

Nicholas P. Godici

*Attesting Officer*

NICHOLAS P. GODICI
*Acting Director of the United States Patent and Trademark Office*